US005242470A

United States Patent [19]

Salter et al.

[11] Patent Number: 5,242,470

[45] Date of Patent: Sep. 7, 1993

[54] PELLETIZING COAL OR COKE WITH STARCH PARTICLES

[75] Inventors: James A. Salter, Katy, Tex.; James P. Frederick, Gillette, Wyo.; Edward C. Sumner, IV, Houston, Tex.

[73] Assignee: Zeigler Coal Holding Company, Fairview Heights, Ill.

[21] Appl. No.: 742,820

[22] Filed: Aug. 9, 1991

[51] Int. Cl.[5] ..... C10L 5/14

[52] U.S. Cl. ..... 44/577; 44/552; 44/560

[58] Field of Search ..... 44/577, 560, 552; 264/141, 118

[56] References Cited

U.S. PATENT DOCUMENTS

| | | | |
|---|---|---|---|
| 2,164,950 | 7/1939 | Schulze | 44/636 |
| 4,003,717 | 1/1977 | Cass et al. | 44/577 |
| 4,217,086 | 8/1980 | Christian | 425/384 |
| 4,405,331 | 9/1983 | Blaustein et al. | 44/577 |

*Primary Examiner*—Prince Willis, Jr.
*Assistant Examiner*—Alan D. Diamond
*Attorney, Agent, or Firm*—Polster, Lieder, Woodruff & Lucchesi

[57] ABSTRACT

Coal or other fine particles are pelletized by mixing relatively moist particles of them with fine particles of a waste product collected during grain transport and storage and extruding or pelletizing the mixture without extensive heating or steaming.

5 Claims, 3 Drawing Sheets

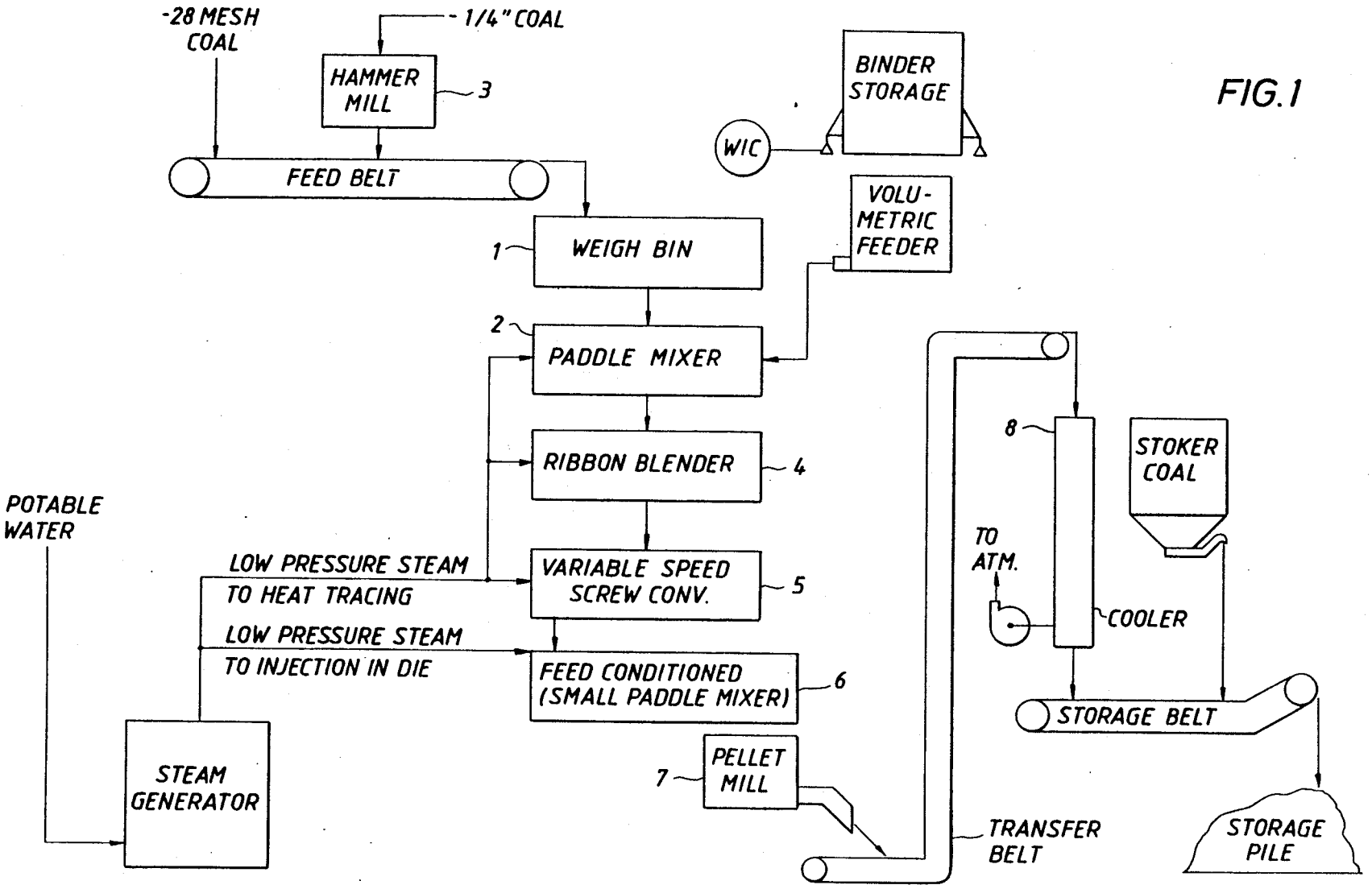
FIG. 1
-28 MESH COAL
- 1/4" COAL
HAMMER MILL
3
FEED BELT
WEIGH BIN
1
BINDER STORAGE
WIC
VOLU-METRIC FEEDER
PADDLE MIXER
2
RIBBON BLENDER
4
VARIABLE SPEED SCREW CONV.
5
FEED CONDITIONED (SMALL PADDLE MIXER)
6
PELLET MILL
7
LOW PRESSURE STEAM
TO HEAT TRACING
LOW PRESSURE STEAM
TO INJECTION IN DIE
STEAM GENERATOR
POTABLE WATER
8
TO ATM.
COOLER
STOKER COAL
STORAGE BELT
STORAGE PILE
TRANSFER BELT

PELLETIZING COAL OR COKE WITH STARCH PARTICLES

BACKGROUND OF THE INVENTION

This invention relates to pelletizing or briquetting fine particles of coal or coke. More particularly, the invention relates to a process in which the pelletizing of such particles is improved by a specific combination of steps that make it feasible to use waste dust from grain elevators as a binder comprising finely divided by-product or co-product collected during the transport and storage of one or more types of grains, with substantially no preprocessing of the coal or coke.

Numerous processes have been proposed for pelletizing or briquetting particles of coal or coke, for example, in patents such as the following: U.S. Pat. No. 44,994, issued over a century ago, teaches that coal dust can be pelletized by saturating it with a solution of starch, pressing or otherwise forming it into blocks or lumps and drying it, in the sun or by other suitable means. U.S. Pat. No. 852,025 discloses preparing coal for briquetting by drying and heating it, mixing in an asphaltic binder material, then heating, cooling, and compacting the mixture. U.S. Pat. No. 1,121,325 discloses briquetting coal by mixing dry coal and starch, then adding steam which is saturated with oil, then compressing and thermally drying the mixture. U.S. Pat. No. 1,851,689 discloses briqueting coal by mixing the coal with a starch/oil emulsion then autoclaving it at 300° F. U.S. Pat. No. 4,049,392 discloses an extrusion apparatus described in U.S. Pat. No. 3,989,433, for extruding rod-like bodies from coal-containing particulate mixtures, and having means for adjusting the length and density of the extruded particles.

SUMMARY OF THE INVENTION

The present invention is an improvement in a process in which relatively fine particles of coal or coke are mixed with a binder material and pelletized. The improvement is effected by the following combination of steps: Coal or coke particles which, at substantially ambient temperature, are disposed within a mixture having a top particle size of about 28 mesh with at least about 50 percent of the particles being smaller than 48 mesh, and having a surface moisture content of about 2–20 percent by weight depending on the coal type. While maintaining about the same surface moisture content and without heating the particles above about 250° F., the coal or coke particles are blended with a binder material which consists essentially of fine particles of grain dust collected as a by-product of grain transport and is present in an amount providing a selected pellet crush strength of 5–60 but preferably between about 15–50 pounds per linear inch. Then, while maintaining substantially the same moisture content and temperature, the blend of coal particles is pelletized under pressure by a means inclusive of an extruding action.

BRIEF DESCRIPTION OF THE DRAWINGS

FIG. 1 is a block flow diagram illustrating a particularly preferred process configuration for the present invention.

DESCRIPTION OF THE INVENTION

Figure 2:
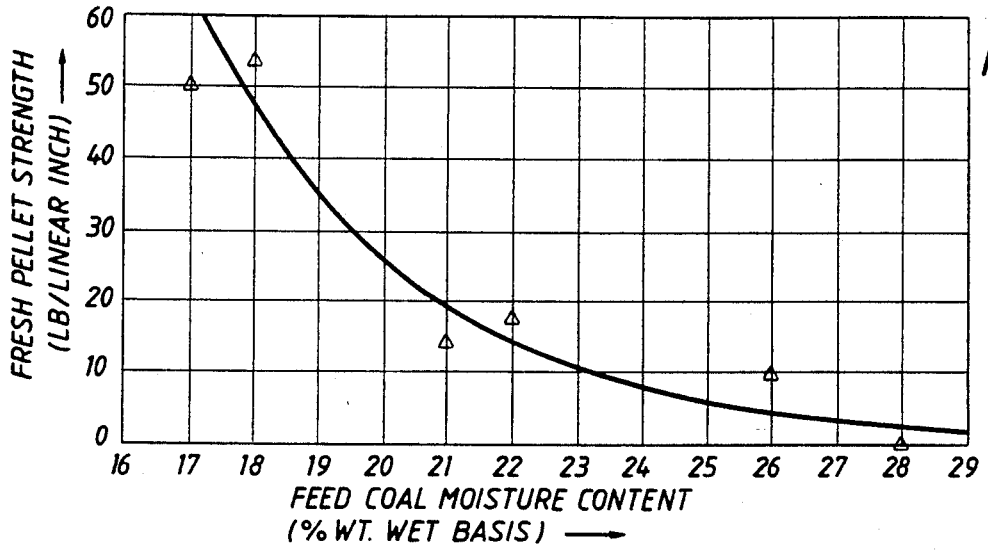
FIG. 2 shows a plot of fresh pellet strength with coal moisture content using a starch particle binder.

The economic feasibility (and thus, for all practical purposes, the operability of a coal pelletizing process) is drastically reduced by needs for extensive heating, drying, cooling treatments and/or expensive binders. Applicants have discovered that pellets of a desirable strength range can be formed by mixing grain elevator dust particles and impurities forming a part of the dust with wet coal particles without steaming, without preheating above about 250° F., and preferably less than 200° F., without significant loss of moisture and adding minor amounts of steam free of hydrocarbons during a pelletizing which involves an extruding action.

FIG. 1 illustrates a particularly preferred basic process configuration which was demonstrated to be suitable for a 6000–8000 pound per hour pilot scale facility.

In typical pilot tests of the invention, the first step in the pelletization process consists of metering coal fines smaller than 28 mesh, (e.g., taken directly from a coal preparation plant) into weigh bin 1 until a selected batch weight is reached. Each batch is subsequently discharged into a paddle (or similar type) mixer 2 which is heat traced or jacketed to maintain a specific temperature between 140° and 240° F. Next, pulverized $-\frac{1}{4}''$ small coal (e.g., a centrifuge product or underflow from a coal screen) that has been pulverized to a specific particle size distribution of smaller than $\frac{1}{4}''$ in size by a means such as hammer mill 3, is metered into the weigh bin and is subsequently discharged onto and blended into the −28 mesh fine coal already in the paddle mixer.

To this mixture an amount of water, based on the moisture content of the solids in the mixer, is added. A binder that is primarily fine particles of a waste product of the grain transport and storage industry is then added to a selected extent. Such a binder preferably makes up about 3 to 12 percent of the total batch weight. This batch is then thoroughly mixed and discharged into a larger agitated surge vessel, such as a ribbon blender 4, which is heat traced or jacketed to maintain a specific temperature between 140°–240° F.

Subsequent batches of coal or coke particles blended with grain dust binder particles are prepared in a similar manner and discharged to a surge vessel so that a continuous flow of material is maintained to equipment downstream of the blender.

The coal/binder blend is discharged into a variable speed volumetric feed screw conveyor 5, which serves as a volumetric feeder to, optionally, a device comprising paddle mixer or feed conditioner 6. Both the feed conveyor and the conditioner, if present, are traced or jacketed and insulated to maintain a selected temperature between about 140°–240° F. This material is then discharged into a pellet mill 7 or an extruder where, preferably, it is exposed to a steam atmosphere, compressed and forced through one or several substantially parallel holes in an abrasion resistant steel die plate (not shown).

Preferably, the die plate holes have a length to diameter ratio of at least 4:1 or, more preferably, 5:1. The extruded compressed coal binder blend emerges from the die holes and is broken or cut to provide a preset range of random length pellets. The fresh pellets are mechanically conveyed to a cooler 8 where they are cooled to ambient temperature.

The cooled pellets are conveyed directly to storage or blended with screened stoker coal and conveyed to storage. While in storage, the pellets or blend of pellets and screened stoker coal may be purged with ambient air depending upon the customer's quality requirements. Shipments to the customer can be made directly from storage.

Table 1 lists a series of runs made without using a binder of any type. The fresh pellet crush strength is well below the minimum required. However, it should be noted for runs 43 and 44 that, although the pellets were too short to crush because they were too brittle and broke off prematurely, the individual pieces were fairly hard. All moistures are according to ASTM D 121-78 and are given on a wet basis.

By doing this, two variables were actually changed at the same time; i.e., the particle size distribution (PSD) was changed as well as the moisture. However, by comparing 100/0 and 50/50 blends, which were made at nearly the same feed moisture (21.5 and 22.2% weight, respectively) but significantly different PSD's, to 50/50 and the 0/100 blends in which both the moisture and PSD were changed, it became clear that the feed moisture is the dominant factor.

Figure 3:
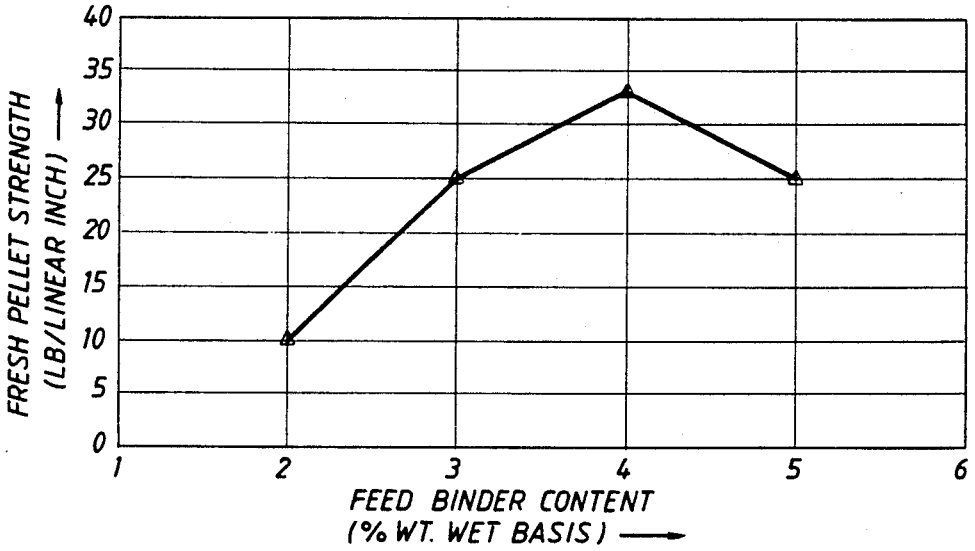
FIG. 3 shows a plot of fresh pellet strength versus feed binder content using a coarse starch binder.

FIG. 3 demonstrates the effect of varying the percentage of refined but unenhanced cornstarch binder added while holding all other variables as constant as reasonably practical, using Amaiso corn starch binder and −28 mesh Illinois #5 coal (at 22% wt. moisture). It can be seen from this data that there appears to be a maximum strength at the 4% weight binder level. The 5% data point was repeated specifically to verify that the low crush strength data from the repeat run confirmed the original run results, it must be noted that the repeat run feed coal moisture was slightly higher (i.e., 28.2% vs. 22.0%). Thus, the crush strength from this run would have been higher had the intial moisture been identical. But, based on results such as those given in FIG. 2 it is not likely that the crush strength would have exceeded 25 lb/linear inch and thus would still be significantly lower than the 33 lb/linear inch strength attained at 4% binder. It must also be noted that the strength of the fresh pellets at 2% is considerably lower than would be expected if the feed moisture had been in the low 20's or upper teens, as was the case with the other runs, rather than at 27% weight.

TABLE 1

NO BINDER PELLETIZATION TRIALS

| Test No. | Feed Coal Tyler Mesh | Feed Coal % Wt $H_2O$ | Binder Type | Blend % Wt $H_2O$ | Fresh Pellet Strength Lb/ Length In. | Fresh Pellet Strength/Lb/ Linear Inc. | Fresh Pellet % Wt $H_2O$ |
|---|---|---|---|---|---|---|---|
| 41 | 28 × 70 | 26.2 | None | 26.2 | 3.0/0.66 | 4.6 | 25.1 |
| 42 | 75%-28 × 70 | 25.1 | None | 23.0 | 3.1/0.47 | 6.6 | 21.8 |
| | 25% 75% < 48 | 17.4 | | | | | |
| 43 | 50% 28 × 70 | 22.5 | None | 19.3 | N/A | N/A | 17.8 |
| | 50%-75% < 48 | 17.1 | | | | | |
| 44 | 25% 28 × 70 | 22.9 | None | 18.3 | N/A | N/A | 16.6 |
| | 75%-75% < 48 | 17.2 | | | | | |

FIG. 2 illustrates the effect of feed coal moisture on the fresh pellet crush strength, using nominally −28 mesh Illinois #5 coal and 5 percent Amaiso corn starch (available from American Maise-Products Company of Hammond, Ind.) as a binder. As soon as the moisture of the feed coal rose to the maximum expected in the fine coal centrifuge product stream; i.e., 28 percent, the fresh pellet crush strength essentially went to zero. At this point various binders (e.g. hydrated lime, unslaked lime, portland cement) were tried in an attempt to improve the crush strength by binder addition alone. Although some slight improvements were seen, crush strengths were well below 7.5 lb/linear inch.

It was apparent that the moisture of the feed coal should be reduced. To accomplish this without thermally drying, nominal ¼"×28 mesh coal from a small coal centrifuge was pulverized to 75 percent less than 48 mesh and blended in various proportions with the wet 28×65 mesh samples from the fine coal centrifuge.

Table 2 illustrates the results from a variety of binders tested in an effort to reduce the feed moisture, reduce the amount of expensive binder by diluting it with a cheaper material, or try some innovative binders based on "waste" or off-spec streams. None of these runs stand out significantly compared to cornstarch alone when the feed moisture is in the 18–22% range.

The starch/unslaked lime may be of interest because the product may prove to have enhanced sulfur capture/retention properties and may therefore demand a premium price in the market place.

TABLE 2

MISCELLANEOUS BINDERS PELLETIZATION TRIALS

| Test No. | Feed Coal Tyler Mesh | Feed Coal % Wt $H_2O$ | Binder Type | Binder % Wt | Blend % Wt $H_2O$ | Fresh Pellet Temp. °F. | Fresh Pellet Strength Lb/ Length of Pellet | Fresh Pellet Strength/Lb/ Linear Inch | Fresh Pellet % Wt $H_2O$ |
|---|---|---|---|---|---|---|---|---|---|
| 53 | 50% 28 × 70 | 29.9 | A1CS | 3 | 23.0 | 100 | 8.6/0.86 | 10.0 | 22.0 |
| | 50%-70% < 200 | 14.0 | ACCSPV200 | 2 | | | | | |
| 54 | 50% 28 × 70 | 34.7 | A1CS | 3 | 23.5 | 94 | 8.8/0.86 | 10.2 | 22.7 |
| | 50%-70% < 200 | 13.9 | ACCSPV200 | 3 | | | | | |
| 10 | 28 × 70 | 30.9 | A1CS | 2 | 29.5 | 93 | 1.3/0.64 | 2.0 | 29.2 |
| | | | SL | 2 | | | | | |
| 55 | 50% 28 × 70 | 33.1 | A1CS | 3 | 23.0 | 163 | 11.2/0.69 | 16.2 | 19.0 |
| | 50%-70% < 200 | 14.3 | UL | 2 | | | | | |
| 56 | 50% 28 × 70 | 33.7 | A1CS | 3 | 23.2 | 179 | 11.2/0.77 | 14.5 | 20.0 |

TABLE 2-continued

MISCELLANEOUS BINDERS PELLETIZATION TRIALS

| Test No. | Feed Coal Tyler Mesh | Feed Coal % Wt $H_2O$ | Binder Type | Binder % Wt | Blend % Wt $H_2O$ | Fresh Pellet Temp. °F. | Fresh Pellet Strength Lb/ Length of Pellet | Fresh Pellet Strength/Lb/ Linear Inch | Fresh Pellet % Wt $H_2O$ |
|---|---|---|---|---|---|---|---|---|---|
| | 50%-70% < 200 | 14.2 | UL | 3 | | | | | |
| 12 | 28 × 70 | 30.4 | A1CS | 3 | 28.3 | 112 | N/A | N/A | N/A |
| | | | UL | 4 | | | | | |
| 13 | 28 × 70 | 30.4 | UL | 5 | 27.0 | 89 | 2.2/0.66 | 3.3 | N/A |
| 14 | 28 × 70 | 31.2 | PC | 5 | 27.8 | 135 | 1.4/0.67 | 2.1 | N/A |
| 19 | 28 × 70 | 24.4 | 85% AP100 | 2 | 23.2 | 96 | 3.6/0.59 | 6.1 | 22.1 |
| | | | 10% N91.6 | | | | | | |
| | | | 5% K1104 | | | | | | |
| 33 | 50% 28 × 70 | 28.9 | 80% AP100 | 2 | 23.7 | 117 | 7.5/0.71 | 10.6 | 21.9 |
| | 50%-75% < 48 | 16.8 | 10% N91.6 | | | | | | |
| | | | 10% K1104 | | | | | | |
| 45 | 50% 28 × 70 | 23.2 | 75% AP100 | 2 | 19.8 | 118 | 7.7/0.59 | 13.0 | 18.7 |
| | 50%-75% < 48 | 17.4 | 10% N91.6 | | | | | | |

A1CS = AMAIZO ® 100-Corn Starch
SL = Hydrated Lime
UL = Unslaked Lime
PC = Portland Cement
ACCB = Am. Colloid Bentonite
ACC 350 = ACCB-ACCOFLOC 350
ACCSPV350 = ACCB-Western Bentonite
AP100 = Fuel Oil
K91.6 = NEODOL ® 91.6
K1104 - KRATON ® 1104

Figure 4:
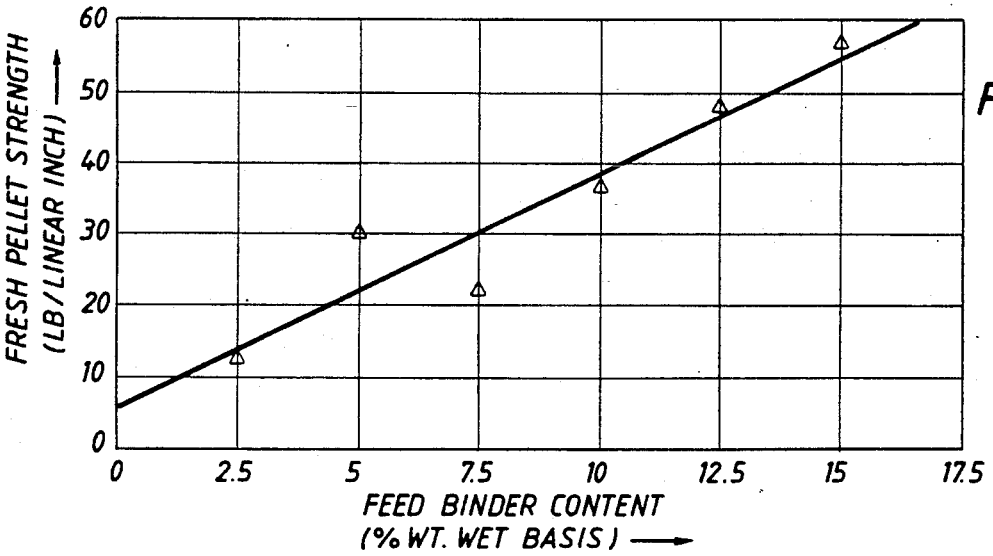
FIG. 4 shows a plot of fresh pellet strength with feed binder content using TEDAR-1000 as a binder.
Figure 5:
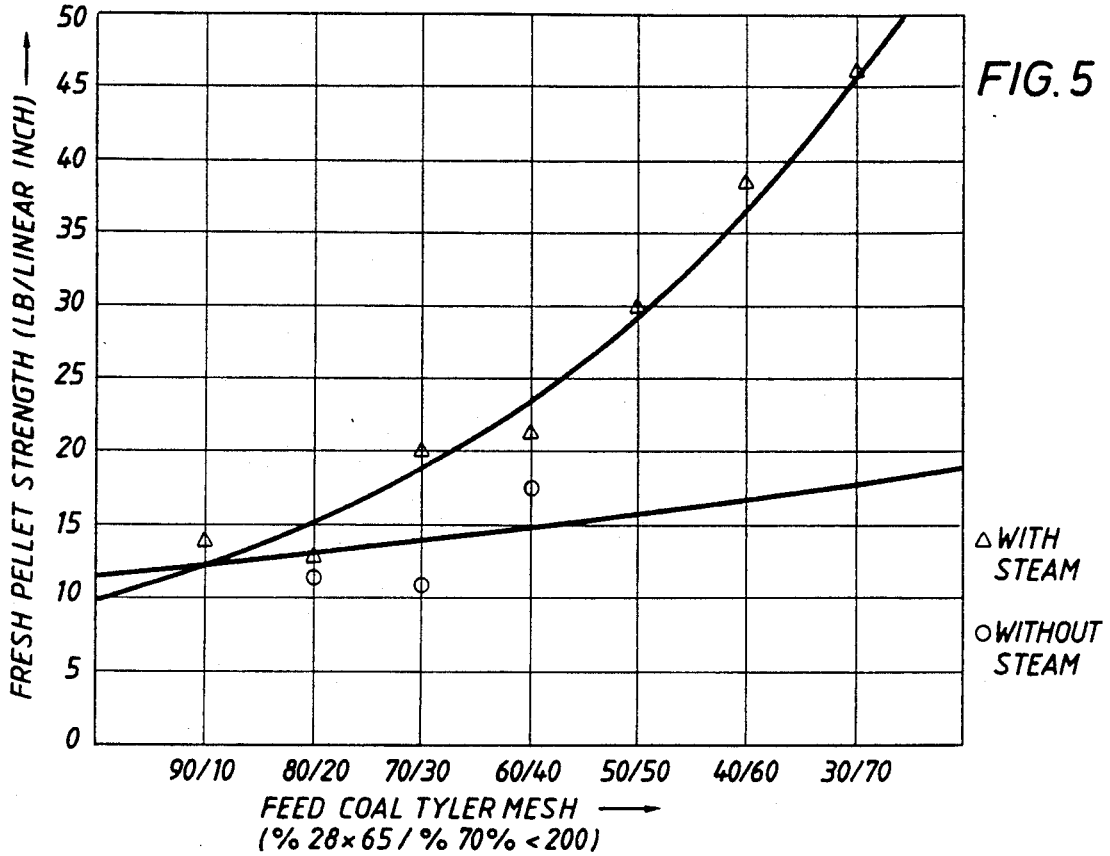
FIG. 5 shows a plot of fresh pellet strength with decreasing coal particle size and decreasing moisture.

FIG. 4 illustrates the effect of varying the binder content, using a 50/50 blend of 28×65 mesh fine coal centrifuge product and 70% −200 mesh pulverized from ¼" screen down to 28 mesh small coal centrifuge product and a grain industry waste product that performs very effectively as a coal pellet binder. This binder material, which is named TEDAR-1000, is high in starch, low in cost and is readily available. Since TEDAR-1000 is a relatively inexpensive binder, it is possible to select the desired pellet strength by varying the amount of binder for a given feed moisture content. TEDAR-1000 is Trapped Elevator Dust As Received from a grain elevator. FIG. 5 primarily demonstrates the effect of decreasing the feed moisture content by blending more of the drier 70% less than 200 mesh feed with the wetter 28×65 mesh feed on the fresh pellet strength. However, because the drier feed also had a finer particle size distribution (PSD), this figure also shows the effect of decreasing the feed PSD. The binder and coal used were, respectively, TEDAR-1000 and Illinois #5.

Table 3 illustrates that the effect of steam addition on the fresh pellet strength is enhanced by preheating the moisture in the feed coal. Preheating the feed resulted in 12 to 74% higher fresh pellet strengths than when the feed was not preheated. It is also apparent from runs 249, 250 and 251, which repeat of runs 244, 246, and 248 respectively, that the steam addition rate required to give the maximum fresh pellet strength was more nearly approached when the steam line was inadvertently pinched off in the original runs.

TABLE 3

EFFECT OF PREHEAT WITH STEAM ADDITION PELLETIZATION TRIALS

| Test No. | Feed Coal Tyler Mesh | Feed Coal % Wt $H_2O$ | Binder Type | Binder % Wt | Blend % Wt $H_2O$ | Fresh Pellet Temp. °F. | Fresh Pellet Strength Lb/ Length of Pellet | Fresh Pellet Strength/Lb/ Linear Inch | Fresh Pellet % Wt $H_2O$ |
|---|---|---|---|---|---|---|---|---|---|
| 243 | 50% 28 × 100D | 21.7 | A1CS | 3 | 18.1 | 157 | 14.4/0.72 | 20.1 | 16.7 |
| | 50%-86% < 48 | 15.3 | w/Preheat | | | | | | |
| 244 | 50% 28 × 100D | 21.7 | A1CS | 3 | 18.1 | 120 | 19.0/0.75 | 25.4 | 17.3 |
| | 50%-86% < 48 | 15.3 | w/Preheat | | | | | | |
| | | | w/Steam | | | | | | |
| 245 | 50% 28 × 100D | 22.2 | TEDAR | 7.5 | 17.7 | 127 | 26.1/0.84 | 30.9 | 16.9 |
| | 50%-86% < 48 | 15.7 | w/Preheat | | | | | | |
| 246 | 50% 28 × 100D | 22.2 | TEDAR | 7.5 | 17.7 | 161 | 43.0/0.90 | 47.6 | 15.8 |
| | 50%-86% < 48 | 15.7 | w/Preheat | | | | | | |
| | | | w/Steam | | | | | | |
| 247 | 50% 28 × 100D | 21.8 | NTCO1 | 7.5 | 17.7 | 144 | 35.7/0.94 | 38.0 | 16.1 |
| | 50%-86% < 48 | 15.3 | w/Preheat | | | | | | |
| 248 | 50% 28 × 100D | 21.8 | NTCO1 | 7.5 | 17.7 | 132 | 40.0/0.93 | 43.2 | 16.4 |
| | 50%-86% < 48 | 15.3 | w/Preheat | | | | | | |
| | | | w/Steam | | | | | | |
| 249* | 50% 28 × 100D | 21.5 | A1CS | 3 | 16.3 | 165 | 25.0/0.94 | 26.6 | 18.2 |
| | 50%-86% < 48 | 15.0 | w/Preheat | | | | | | |
| | | | w/Steam | | | | | | |
| 250* | 50% 28 × 100D | 22.0 | TEDAR | 7.5 | 19.6 | 152 | 37.9/0.95 | 39.9 | 17.7 |
| | 50%-86% < 48 | 15.0 | w/Preheat | | | | | | |
| | | | w/Steam | | | | | | |
| 251* | 50% 28 × 100D | 20.9 | NOCO1 | 7.5 | 18.9 | N/A | 34.0/0.94 | 36.3 | 19.1 |
| | 50%-86% < 48 | 15.0 | w/Preheat | | | | | | |

TABLE 3-continued

EFFECT OF PREHEAT WITH STEAM ADDITION PELLETIZATION TRIALS

| Test No. | Feed Coal Tyler Mesh | Feed Coal % Wt $H_2O$ | Binder Type | Binder % Wt | Blend % Wt $H_2O$ | Fresh Pellet Temp. °F. | Fresh Pellet Strength Lb/ Length of Pellet | Fresh Pellet Strength/Lb/ Linear Inch | Fresh Pellet % Wt $H_2O$ |
|---|---|---|---|---|---|---|---|---|---|
| | | | w/Steam | | | | | | |

*Runs 249, 250 and 251 were repeats of Runs 244 246 and 248, respectively. Steam line was found to be pinched after original runs.
A1CS = AMAIZO ® 100-Corn Starch
TEDAR = Tabor Elev. Dust - as rec'd
NTCO1 = Naples Terminal Co. No. 1

Figure 6:
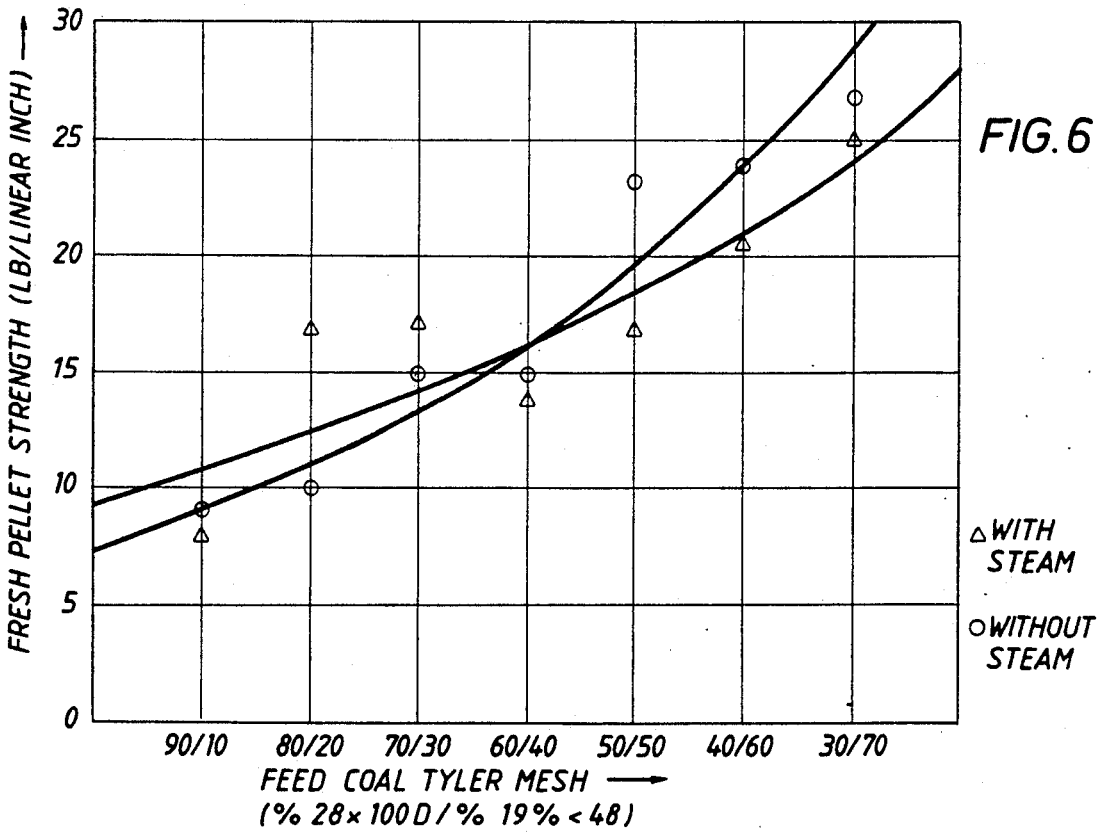
FIG. 6 shows a plot of data typical of that obtained by a series of tests, of fresh pellet strength with decreasing coal particle size and decreasing moisture, for investigating the effect of varying the particle size distribution while maintaining substantially the same moisture content.

FIG. 6 illustrates the effect of varying the particle size distribution while maintaining approximately the same feed moistures. As the mesh size of the dryer blend component is increased from 70% less than 200 mesh to 56% less than 200 mesh to 19% less than 48 mesh, the fresh pellet strength decreased significantly; e.g., by about 50% for the 50/50 blend. The binder used was 7.5% TEDAR-1000 and the coal used was Illinois #5 and had an average blend moisture content of 21.4%.

Suitable Compositions and Techniques

In general, the present process is applicable to substantially any types of coal or coke particles smaller than about 28 mesh. Suitable coals include fine grain size coking or non-coking coal or coke fines, or the like.

The present process can be conducted with substantially any of the presently available devices or techniques for accomplishing the functions such as weighing, mixing, blending, conditioning, and the like.

Where heating is desirable, the heat can be supplied by substantially any source. The pelletizer feed conditioning is preferably limited to thoroughly mixing the blend of coal or coke and binder particles while keeping the prepelletizing heating temperatures below about 200° F. A small quantity of steam is preferably injected into or behind the dye ring plate of an extruder to provide enough surface moisture to maximize compaction during extrusion. During such an injection, the surface moisture of the particles should not be significantly increased. As known in the art, too much steam will result in soft pellets and ultimately inhibit extrusion and too little steam will cause the pellets to set up and plug the die holes and/or cause production rates to be severely reduced. Those skilled in the art can readily recognize a provision of just enough surface moisture to maximize compaction during extrusion. Such a recognition can be based on the performance of the pelletizing system and the appearance of the product.

The present invention requires significantly less energy to produce stoker quality fuel from wet coal fines than previously known processes. This is accomplished by using a pelletizing process inclusive of an extruding action instead of relying on briquetting or disc drum pelletizing procedures and at the same time, controlling the moisture and particle size distribution of the blend of coal or coke particles and binder. The mixing of specific proportions of coarser coal, such as ¼" to 0 that has been pulverized to at least 70% less than 48 mesh (297 microns) with wetter fine coal is particularly preferred. Such fines can advantageously be those produced by upstream coal processing or cleaning steps having top particle sizes in the order of 28 mesh (597 microns).

Advantageously, the present process can be conducted at essentially atmospheric gas pressure except with respect to the pressures generated within the die plate or ring itself. In addition, the process requires no devolatilization except for the surface moisture of the coal or coke particles being pelletized.

The binder used in the present process can be comprised essentially of finely divided bi-products or co-products of grain transport and storage. Such particles are preferably −200 mesh but can contain up to 12% weight greater than 14 mesh that can be substantially any grain industry waste product which is high in starch, and advantageously is low in cost and readily available. Those skilled in the art can readily recognize the provision of just enough surface moisture to maximize compaction during extrusion. Such a recognition can be based on the performance of the pelletizing system and the appearance of the product.

The present invention requires significantly less energy to produce stoker quality fuel from wet coal fines than previously known processes. This is accomplished by using a pelletizing process inclusive of an extruding action instead of relying on briquetting or disc drum pelletizing procedures and at the same time, controlling the moisture and particle size distribution of the blend of coal or coke particles and binder. The mixing of specific proportions of coarser coal, such as ¼" to 0 that has been pulverized to at least 70% less than 48 mesh (297 microns) with wetter fine coal is particularly preferred. Such fines can advantageously be those produced by upstream coal processing or cleaning steps having top particle sizes in the order of 28 mesh (597 microns).

Advantageously, the present process can be conducted at essentially atmospheric gas pressure except with respect to the pressures generated within the die plate or ring itself. In addition, the process requires no devolatilization except for the surface moisture of the coal or coke particles being pelletized.

The binder used in the present process can be comprised essentially of finely divided bi-products of co-products of grain transport and storage. Such particles are preferably −200 mesh but can contain up to 12% weight greater than 14 mesh that can be substantially any grain industry waste product which is high in starch, and advantageously is low in cost and readily available. The various available treated or untreated corn products are suitable examples and the waste product designated as TEDAR-1000 is particularly preferred.

The binder of the present invention comes from what is basically a waste stream of the grain elevator, milling and processing industries. It consists of the fine particulate materials and hulls blown off the grain during transport or processing and therefore varies in composition throughout the year as the various grains are harvested. When used as a binder for coal or coke fines, the dust must be primarily collected during corn transfer, but may contain up to 5% weight soybean and/or 5% weight wheat dust. Wheat dust and soybean dust are considered to be acceptable up to the levels noted. The following can be considered a typical composition:

| COMPONENT | % WEIGHT RANGE as received | TEDAR EX-AMPLE as received |
|---|---|---|
| Corn starches/Sugars (40 to 60% starches) | 65-90 | 73 |
| Soybean or Wheat starches/sugars | 0-10 | 5 |
| Grain hulls/Misc. Natural Organics, bees wings and rodent feces | 0-3 | 2 |
| Sand/Clay Minerals ($SiO_2$, CaO, MgO) | 5-10 | 8 |
| Water | 10-15 | 12 |

What is claimed is:

1. A process for pelletizing coal comprising:

disposing coal or coke particles in a mixture which, at about ambient temperature, has a top particle size of about 28 mesh with at least about 50 percent of the particles being smaller than about 48 mesh, has a surface moisture content of about 2-20% by weight;

blending into the mixture 3 to 12% by weight of a binder material, consisting essentially of finely divided particles of grain dust collected in grain transport and storage in an amount effective for providing a pellet crush strength of about 5-60 lbs per linear inch while maintaining about the same moisture content of said mixture while maintaining the mixture of coal or coke particles to between 140° and 240° F.; and pelletizing the mixture of coal or coke and binder material under pressure sufficient to convert the mixture to pellets by means inclusive of an extruding action.

2. The process of claim 1 in which, during the pelletizing step, the particles of coal or coke and binder material are contacted with enough steam to provide a surface moisture which substantially maximizes the surface compaction during the pelletizing step.

3. The process of claim 1 in which the binder material consists essentially of fine particles of raw starch.

4. The process of claim 1 in which the total moisture content of the mixtures of coal or coke particles which are blended with the binder particles is about 14%-24% by weight.

5. The process of claim 4 in which the moisture content of the coal or coke particles is adjusted by mixing proportions of coarser and drier coal particles with wetter and finer coal particles.

* * * * *